United States Patent [19]

Folsberg

[11] Patent Number: 4,689,141

[45] Date of Patent: Aug. 25, 1987

[54] SEPARATOR FOR SORTING PARTICULATE MATERIAL, WITH A PLURALITY OF SEPARATELY ADJUSTABLE GUIDE VANE SETS

[75] Inventor: Jan Folsberg, Copenhagen, Denmark

[73] Assignee: F. L. Smidth & Co. A/S, Copenhagen, Denmark

[21] Appl. No.: 849,771

[22] Filed: Apr. 9, 1986

[30] Foreign Application Priority Data

Jun. 3, 1985 [GB] United Kingdom ..... 8513968

[51] Int. Cl.[4] ..... B04C 5/103

[52] U.S. Cl. ..... 209/144; 209/148; 209/154; 241/79.1; 241/119

[58] Field of Search ..... 209/133, 144, 148, 154; 241/79.1, 119

[56] References Cited

U.S. PATENT DOCUMENTS

| | | | |
|---|---|---|---|
| 928,953 | 6/1909 | Emerick | 209/148 X |
| 1,517,900 | 12/1924 | Gay | 209/148 |
| 3,372,805 | 3/1968 | Lykken et al. | 209/144 |
| 4,059,507 | 11/1977 | Nobuo | 209/148 X |
| 4,296,864 | 10/1981 | Misaka et al. | 209/154 X |
| 4,470,902 | 9/1984 | Yoshimori | 209/144 X |

FOREIGN PATENT DOCUMENTS

| | | | |
|---|---|---|---|
| 0353481 | 4/1921 | Fed. Rep. of Germany | 209/133 |

*Primary Examiner*—Robert B. Reeves
*Assistant Examiner*—Scott H. Werny
*Attorney, Agent, or Firm*—Brumbaugh, Graves, Donohue & Raymond

[57] ABSTRACT

A separator for sorting particulate material has a rotor (1) with vanes (3); static, separately adjustable guide vanes (8,9); a casing (14) defining an inlet duct for material suspended in a conveying gas; an outlet (7) for a suspended fine fraction; and a hopper (12) for collecting a coarse fraction.

3 Claims, 1 Drawing Figure

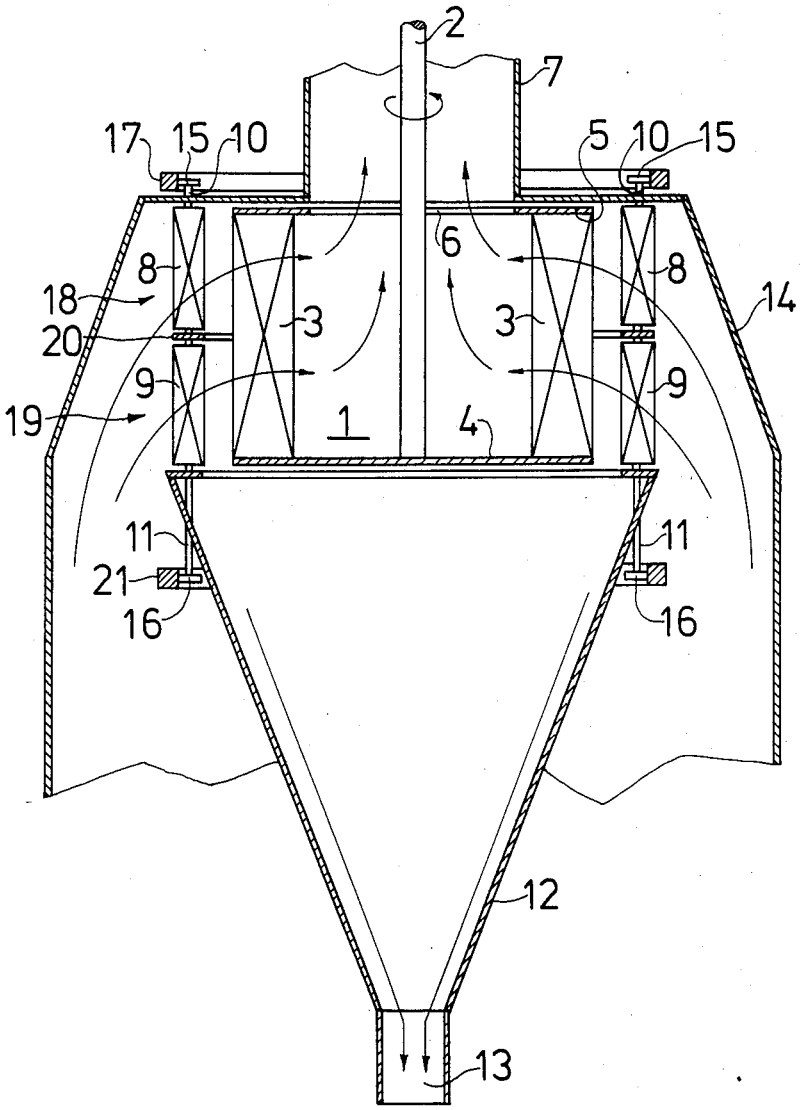
2
7
17
15
10
5
10
15
6
8
8
18
3
3
14
20
9
9
19
1
4
11
11
21
16
16
12
13

SEPARATOR FOR SORTING PARTICULATE MATERIAL, WITH A PLURALITY OF SEPARATELY ADJUSTABLE GUIDE VANE SETS

BACKGROUND OF THE INVENTION

The invention relates to a separator for sorting particulate material into a fine fraction and a coarse fraction, the separator comprising a rotor with a substantially vertical axis and vanes, an adjustable guide vane system surrounding the rotor and a housing encasing the guide vane system and the rotor and having one or more inlet ducts for the supply of a conveying gas and unsorted material, an outlet duct from at least one end of the separator for discharging the separated fine material fraction suspended in the conveying gas and an outlet duct beneath the rotor and the guide vane system for discharging the separated coarse material fraction for further treatment. Such a separator is hereinafter referred to as of the kind described.

In such a separator the material to be sorted in the separator may either be introduced into the separator separately from the conveying gas into which it is then suspended just inside the guide vane system, or be presuspended in the conveying gas outside the separator so as to be fed together with the gas through the guide vane system.

In both cases the material/gas suspension is passed into the rotating rotor vanes where, as a result of the centrifugal force acting upon the material, the coarser material fraction is flung outwards towards the guide vane system.

The centrifugal force may be increased by adjusting the guide vanes so that they form a smaller angle to the tangential direction of the rotor.

The coarser particles in the suspension flung outwards towards the guide vane system will fall down along the inside of the guide vane system to the bottom of the separator to be discharged therefrom, while the finer particles remaining suspended in the gas stream are conveyed through the rotor and out through the outlet duct from the separator and subsequently from the conveying gas e.g. by a precipitator arrangement.

The separated fine fraction consists of nearly all particles below a certain first, smaller grain size, while the coarse fraction consists of nearly all particles above a certain second, larger grain size. Additionally, in both fractions there will be distribution of an intermediate fraction comprising grain size between the first and second grain sizes.

The distribution of particles of intermediate size is a measure of the inability of a separator of the kind described to provide desired precise grain size cut-off point ("cut size"), such that all particles below a certain size pass through the rotor and all particles above that size are flung towards the guide vane system.

The difference in size between the first and second grain sizes indicates the separation sharpness of the separator in question, and this separation sharpness as well as the cut size of the separator, are characteristics of the design of such a separator.

Control both of the cut-size and the separation sharpness of a separator are desired in such cases where a certain grain size distribution in the finished product (the fine fraction) must be obtained, e.g. when grinding cement, where a quite definite grain size distribution is a precondition to the strength properties and workability of the concrete to be produced from the cement.

The cut-size may be controlled by adjusting partly the rotation speed of the rotor and partly the inclination of the guide vanes, while the control of the grain size distribution in the finished product from a separator plant has hitherto required the use of two or more separators working in parallel or in series and being preset for different cut sizes.

SUMMARY OF THE INVENTION

It is the object of the invention to improve the cut-size and separation sharpness control capabilities of a separator of the kind described.

According to the invention, this is achieved by providing the guide vane system as two or more guide vane sets mounted one above the another, and the different guide vane sets are separately adjustable.

With this construction it is possible, using the single rotor but with different adjustments of the guide vane sets, to control separation of the fine material fraction according to a desired grain size distribution which as mentioned is determined by a desired cut-size and separation sharpness. These characteristics are controlled by combination of the different cut-sizes and separation sharpness obtained by appropriate different adjustments of the guide vane sets. This combined but very simple separator is in principle working in the same manner as a plurality of separators in parallel.

Adjustment of the individual guide vane sets is preferably obtained by guide vanes belonging to one and the same guide vane set having means for joint adjustment of the vanes.

In a preferred separator construction, suited for instance for building-in at the top of a vertical roller mill, the guide vane sets are axially offset relatively to one another and at the same radial distance from the rotor axis.

BRIEF DESCRIPTION OF THE DRAWING

The invention will now be explained in more detail by way of an example of a separator according to the invention and with reference to the drawing which diagrammatically shows an axial section of the separator.

DESCRIPTION OF THE PREFERRED EMBODIMENT

The separator has a rotor 1 which is rotatable about a vertical axis and driven by a motor (not shown), via a shaft 2. The rotor 1 has vanes 3 fastened partly to an annular bottom plate 4, and partly to an annular top plate 5. In the top plate 5 there is a central opening 6 leading to an outlet duct 7. Along the circumference of the rotor 1 are mounted two sets 18 and 19 of adjustable guide vanes 8 and 9.

Below the rotor 1 and the guide vanes 8, 9 is mounted a hopper 12 having an outlet 13. The separator is encased by a housing 14 which may form the top part of the mill housing for a vertical roller mill.

The guide vanes 8 are provided with shafts 10 pivotally mounted at the top of the housing 14 and in a stationary ring 20 between the two vane sets 18 and 19, and the guide vanes 9 are provided with shafts 11 pivotally mounted at the top of the hopper 12 and in the ring 20.

Each set 18 or 19 of the guide vanes 8 or 9 are adjusted simultaneously but independently by pinions 15 or 16 mounted at the one end of the shafts 10 or 11 and rotated via an adjustable ring gear 17 or 21.

The separator operates in the following way: Material to be sorted in the separator is supplied suspended in conveying gas upwards within the housing 14 to the rotor area as indicated by arrows and flows in between the vanes 8 and 9 in the two guide vane sets 18 and 19, whereby the suspension is deflected by the inclination of the guide vanes into the direction of rotation of the rotor within the rotor chamber inside the guide vanes. Both the guide vane system and the rotor thus provide for a rotation of the suspension, and owing to the centrifugal force created by this rotation a first separation takes place already at the inner side of the guide vane system. The coarser particles of the suspension will, just inside the guide vane system, be flung outwards again towards the guide vanes 8 and 9 to be stopped by the vanes and fall down into the collecting hopper 12. The remaining part of the material suspension with the finer particles flows in between the rotor vanes 3 where another separating of the particles takes place, the now remaining coarser particles also being flung by the centrifugal force from the rotor outwards towards the guide vane system to fall down into the collecting hopper 12 from which the coarser particles are discharged for further treatment.

The separated finer material fraction still suspended in the conveying gas is carried together with the gas stream through the rotor and leaves the separator through the outlet duct 7 at the top of the separator as a finished product.

I claim:

1. A separator for sorting particulate material into a fine fraction and a coarse fraction, said separator comprising a rotor with a substantially vertical axis and vanes, an adjustable guide vane system surrounding said rotor and a housing encasing said guide vane system and said rotor and having one or more inlet ducts for the supply of conveying gas and unsorted material, an outlet duct from at least one end of said separator discharging the separated fine material fraction suspended in said conveying gas and an outlet duct beneath said rotor and said guide vane system for discharging the separated coarse material fraction for further treatment, wherein said guide vane system consists of two or more sets of guide vanes mounted one above the other, and wherein said two or more sets of guide vanes are separately adjustable such that said guide vanes may be adjusted to form different angles to the tangential direction of the rotor.

2. A separator according to claim 1, wherein said guide vanes of each two or more sets of guide vanes have means for setwise adjustment of said vanes.

3. A separator according to claim 1, wherein said two or more sets of guide vanes are axially offset relatively to one another and at a common radial distance from said rotor axis.

* * * * *